United States Patent [19]

Donovan et al.

[11] 3,963,913

[45] June 15, 1976

[54] WALL MOUNTED DISPLAY SYSTEM

[75] Inventors: Robert W. Donovan, Ridgefield, Conn.; Harvey L. Kolster, Grain Valley, Mo.; Herbert H. Broeker; George W. Bailey, both of Overland Park, Kans.

[73] Assignee: Hallmark Cards, Incorporated, Kansas City, Mo.

[22] Filed: Nov. 7, 1974

[21] Appl. No.: 521,837

Related U.S. Application Data

[62] Division of Ser. No. 414,640, Nov. 12, 1973, Pat. No. 3,865,248.

[52] U.S. Cl. ..... 240/2 AD; 240/2 BV

[51] Int. Cl.[2] ..... F21V 33/00

[58] Field of Search ..... 240/2 AD, 2 BV, 6; 211/86, 90, 134, 148, 149; 248/224

[56] References Cited

UNITED STATES PATENTS

| | | | |
|---|---|---|---|
| 1,560,122 | 11/1925 | Vance | 240/2 AD |
| 1,630,105 | 5/1927 | Bernard | 240/2 AD |

*Primary Examiner*—Monroe H. Hayes
*Attorney, Agent, or Firm*—Schmidt, Johnson, Hovey & Williams

[57] ABSTRACT

A prefabricated, fully adjustable, modular article display system is provided which not only gives the appearance of a built-in, customized design but also may be installed against a wall surface in hiding relationship thereto so that overall finishing of the wall prior to installation of the display units is obviated. This significantly reduces the costs which a property owner or leaseholder must pay for finishing the interior of a retail area in which the units are used. The system is made up of a number of display modules each having a pair of upright, slotted standards which rest on the floor adjacent the wall and that are held thereagainst by clips on the standards which interlock with a Z-shaped tie bar adapted to be secured to the wall. A cantilever mounted valance and soffit assembly adjustably carried by each pair of standards immediately below the ceiling has illuminating means therein for directing light onto the displayed articles therebelow. A finished back panel held in a frame supported by the standards hides the wall therebehind and decorative colored valance panels covering the front portion of each soffit and valance assembly may be easily reversed or replaced as desired with a different outwardly facing colored panel for correlation with seasonal merchandizing promotions. The entire system is prefabricated in a manner permitting rapid installation thereof at the site of use by relatively unskilled labor with a minimum of tools.

9 Claims, 20 Drawing Figures

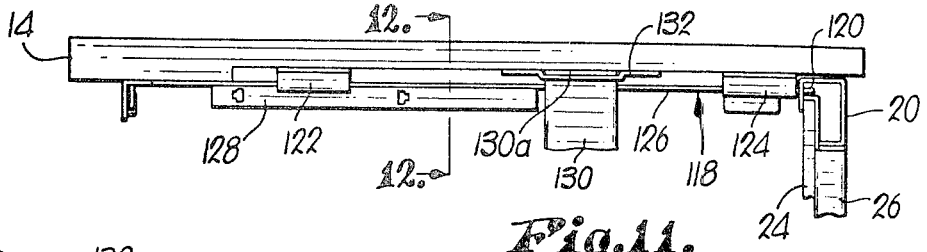
Fig.11.
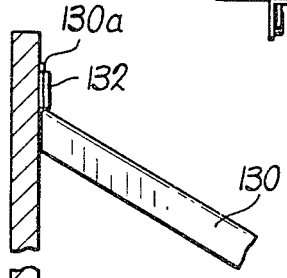
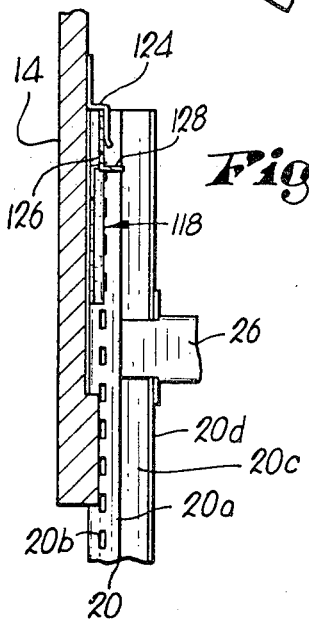
Fig.12.
Fig.17.
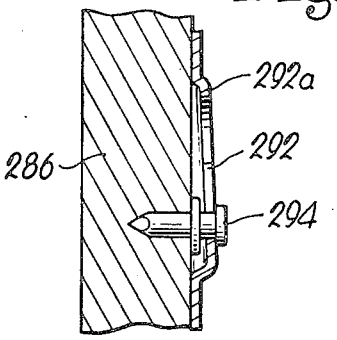
Fig.15.
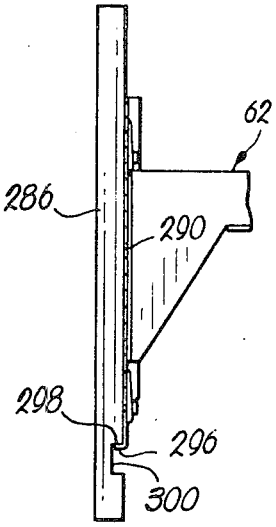
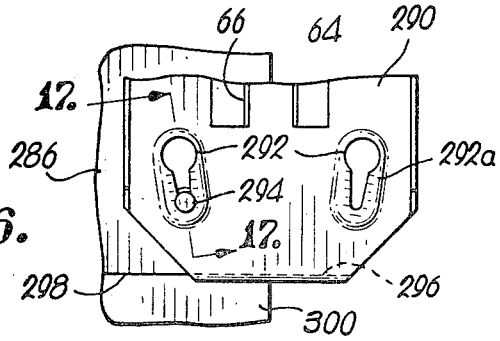
Fig.16.
Fig.13.
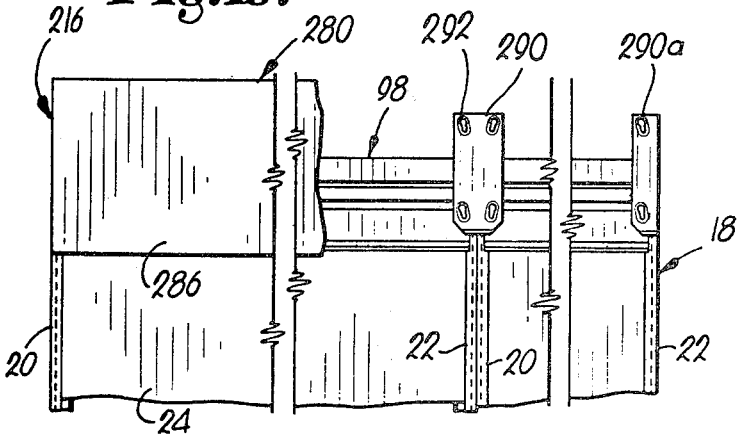
Fig.14.
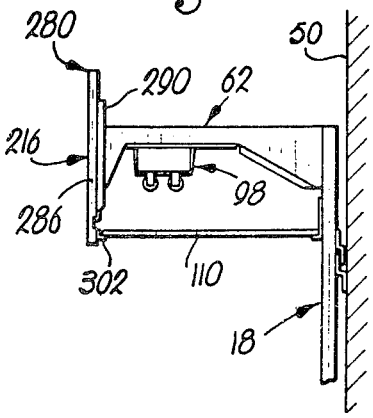

WALL MOUNTED DISPLAY SYSTEM

This is a division of application Ser. No. 414,640, filed on Nov. 12, 1973, now U.S. Pat. No. 3,865,248.

BACKGROUND

This invention relates to a modular wall mounted article display system especially suitable for prefabrication and installation at the site of use with minimum skill and tool requirements while still retaining the overall look and general appearance of a built-in, customized design. An especially important feature of the display equipment is the fact that in the preferred embodiments thereof the components of the same substantially fill the wall area between the floor and an overlying ceiling of the retail area in hiding relationship to at least the major portion of the wall surface so that overall finishing of the latter prior to installation of the article display units is unnecessary. This significantly decreases the finishing costs to an owner or leaseholder of the space in which the display apparatus is installed. The article supports and decorative fronts of the equipment are completely adjustable as desired by the retailer for flexibility of display format without tools of any kind being necessary to make the change.

The display apparatus includes soffit and valance assemblies adapted to be located adjacent the ceiling of the retail space and which serve as supports for illuminating means located to direct light downwardly onto displayed articles therebelow. In one form of the invention, decorative front valance panels are provided across the front of each of the light source areas to hide the same and also present an aesthetically pleasing display area by virtue of the fact that each of the cover panels preferably has a colored face thereon so that by the simple expedient of either reversing the cover panel to bring another color to the front, or by replacing the outermost panel with different colored panels stored therebehind, the decorative effect provided may be changed at will.

Wall mounted shelves of the type which are supported by brackets adjustably mounted on slotted vertical hanger strips have long been used for displaying articles such as merchandise for sale in retail outlets, but these units offer very little aesthetic or structural advantages from a utility standpoint other than adjustability of the shelves and the lower cost thereof in comparison with free standing display cabinets and shelving. Not only was the retailer required to install adjustable shelves of the type which hang from slotted standards on prefinished wall surfaces presenting a decorative appearance, but he was also limited as to the display format which he could use for a particular wall installation. Usually, reliance had to be made entirely on overhead ceiling lights for illuminating the display area. Although retailers who own the property in which they do business have always had to bear the expense of finishing their entire sales area, most lease arrangements entered into today also impose the burden of interior decorating costs on the lessee. This trend has become standard because of the wide variation in interior decor and fixtures for different retail operations. Accordingly, even in the case of leaseholders, they are required not only to pay relatively high square foot lease rates, particularly in advantageous high traffic areas such as new shopping centers, but they also must arrange to finish the interior of their leased space including at least flooring such as carpeting, overhead ceiling structure, wall finishing and all retail fixtures. With increasing labor costs, these overall costs have tended to increase substantially in recent years, particularly if substantial manual labor is involved in finishing the store area. Even after finishing the walls, installing carpets and overhead ceiling units and doing other interior finish work, the retailer was still faced with the alternative of either purchasing very expensive free standing cabinets and shelves for displaying his wares, or decide to rely on slotted standard mounted shelves affixed directly to painted walls or other wall surfaces finished in a manner to impart a pleasing appearance to the display area. Even in the case where free standing shelving was used though, it was still necessary for at least a major portion of the wall surface above the top of the cabinets to be finished, and lighting depended entirely on the availability of overhead illuminating means mounted in the ceiling adjacent thereto.

After spending considerable sums of money for finishing the interior of his retail area, the merchant could retain title only to display equipment which would retain its classification as non-fixtures under the law, otherwise he had to leave such equipment behind if he moved to a different location. This necessitated buying more expensive free standing display units if the retailer was uncertain as to the length of time he might occupy a particular area.

Steadily increasing ownership and leasehold costs have also forced merchants to operate in smaller total space. However, this has been accomplished only at the expense of limitation on customer accessibility to the displayed merchandise, crowded conditions for customer traffic, and decrease in the number and type of articles which could be displayed. For this reason, there has been a demand for prefabricated wall mounted article display units which could be ordered at any one of a number of different effective depths and heights for use under varying location requirements. These needs though have heretofore been met only by custom installations. However, labor and material costs have now increased to levels which have made built-in display equipment virtually prohibitive from a cost standpoint.

It is therefore the primary object of the present invention to provide article display apparatus especially suited for removable mounting on a wall surface in covering relationship thereto and which is supported on the floor but is held against the wall through novel interlocking components that may be quickly and easily installed by relatively inexperienced personnel using hand tools while completely obviating the necessity for the shopkeeper to finish the wall surfaces on which the display apparatus is mounted. Furthermore, the display equipment is not only in modular form but is especially adapted for prefabrication thereof so that display areas of any length may be shelved without custom design and manufacturing of the display structure being required for each installation.

Another important object of the invention is to provide wall mounted display equipment embodying fully adjustable article display supports as well as a vertically shiftable overhead soffit and valance assembly incorporating integral lighting means therein so that the assembly may be positioned adjacent the ceiling regardless of the actual height thereof from the floor while still providing direct illumination on the articles displayed therebelow.

A further important object of the invention is to provide modular wall mounted display apparatus which includes a finished back of relatively inexpensive sheet material which obviates the necessity of the retailer finishing the wall behind the display equipment and significantly lowers the costs of finishing the interior of the display area. In this connection it is an equally important object of the invention to provide one type of display unit incorporating novel valance panels on the front of the soffit and valance assembly above the article display supports and which preferably comprise one or more panels having different colors on opposed faces thereof so that by removably mounting the panels in the normal decorative disposition thereof, the panels may be reversed or replaced as desired with panels of different colors thus permitting the retailer to change the visual effect of his display area at will. This is particularly advantageous for seasonal sales promotions.

As a corollary to the foregoing objects, it is a further important aim of the invention to provide a wall mounted article display system for use in high ceiling areas, or those of somewhat lower height wherein permanent valance panels may be positioned across the front of each of the soffit and valance assemblies in closing relationship thereto using a novel interlocking mechanism which removably holds the panels in fixed disposition and assures tight end to end fit thereof without interfering with proper positioning of the soffit and valance assembly at any desired elevation above the floor. In this manner, the most effective spacing between the top of the display equipment and the overlying ceiling may be achieved depending on the particular conditions of the space in which the units are installed. For example, the provision of cantilever supported assemblies allows the user to install the display equipment at an aesthetically pleasing height relative to the ceiling in the case of unusually high overheads to present a decorative although unobtrusive appearance while still retaining the aforementioned advantages with the sole exception of providing a surface finish on the relatively narrow band of wall between the top of the display apparatus and the ceiling structure.

Another important object of the invention is to provide prefabricated display apparatus for articles of varying types and dimensions wherein the retailer may change the article display supports at will without altering the display equipment and to switch as desired from shelves to bins as may be necessary for a particular product.

Also an important object of the invention is to provide fully adjustable article display apparatus adapted for wall mounting thereof which is prefabricated in modular units wherein the overhead soffit and valance assemblies supporting article illumination means therein are interrupted by panel simulating fin components which break the longitudinal line of the assemblies at strategic locations therealong to enhance the appearance of the display equipment and also provide compensation for any misalignment that may be present between the adjacent colored valance panels across the fronts of the illumination assemblies.

A further important object of the invention is to provide display apparatus as described wherein each of the modular unit slotted standards is provided with an adjustable foot at the lower end thereof so that the relative heights of the standards may be changed as required to assure alignment of the upper ends thereof notwithstanding surface irregularities in the floor.

Also an especially important object of the invention is to provide a modular article display system which uniquely permits utilization thereof without significant change in a wide variety of retail or other article display applications.

Other important objects and features of the present invention will become evident or be explained in detail as the following description progresses.

THE DRAWINGS

Figure 1:
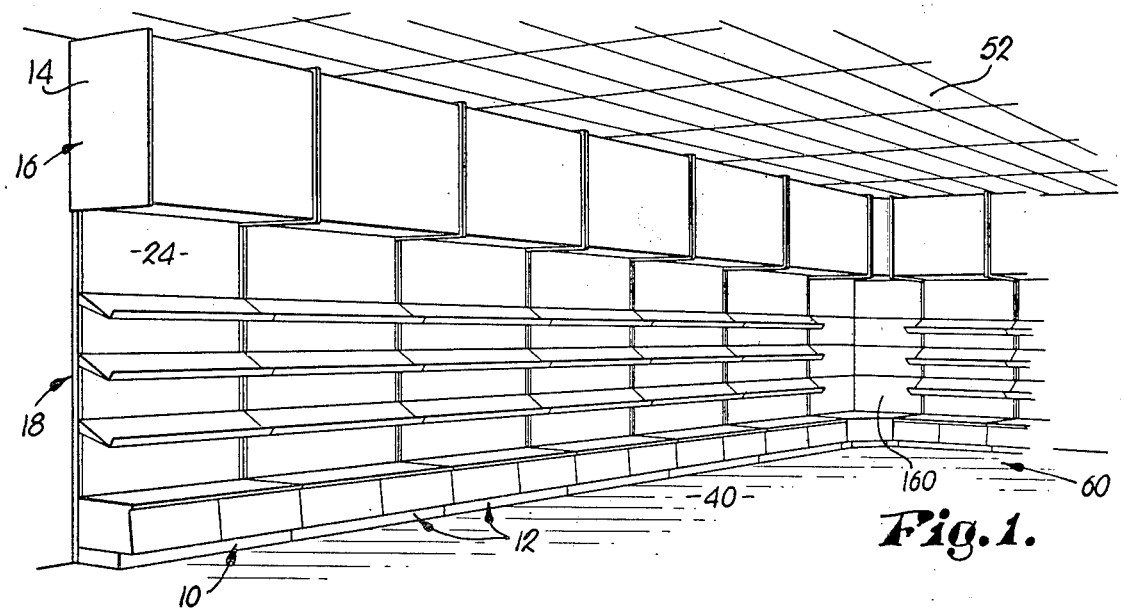
FIG. 1 is a fragmentary perspective view of one corner of a typical retail establishment illustrating the preferred article display apparatus of the invention installed in position for supporting various products and showing the built-in appearance of the units notwithstanding prefabrication thereof as standard sized components.
Figure 18:
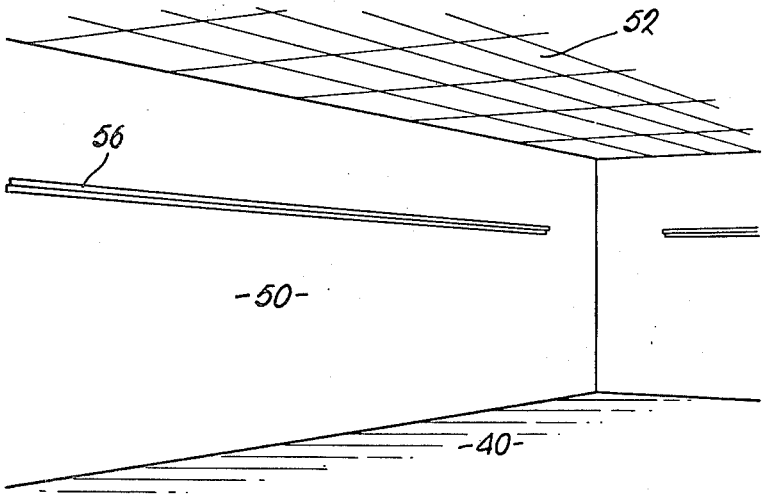
Figure 19:
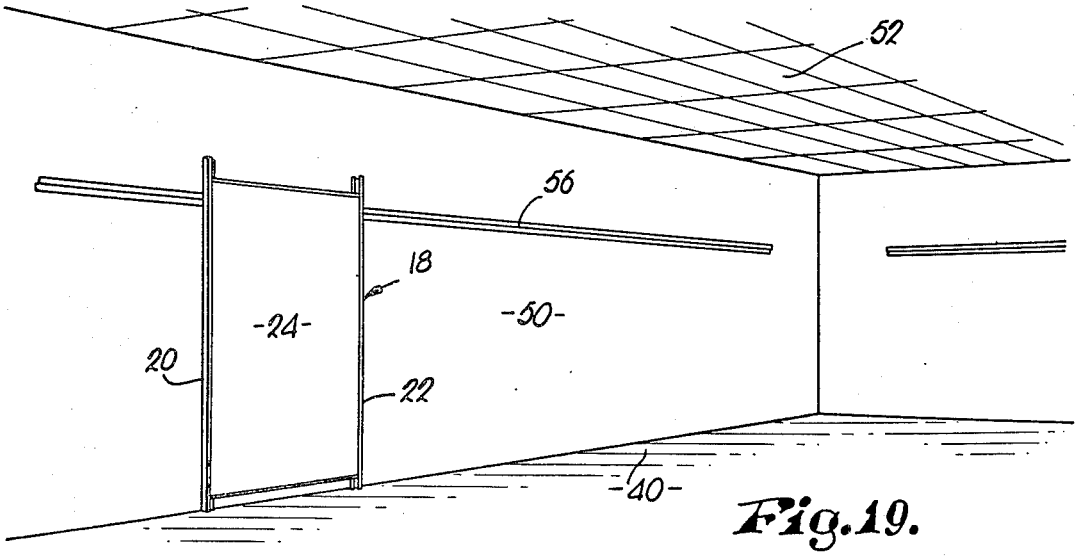
Figure 2:
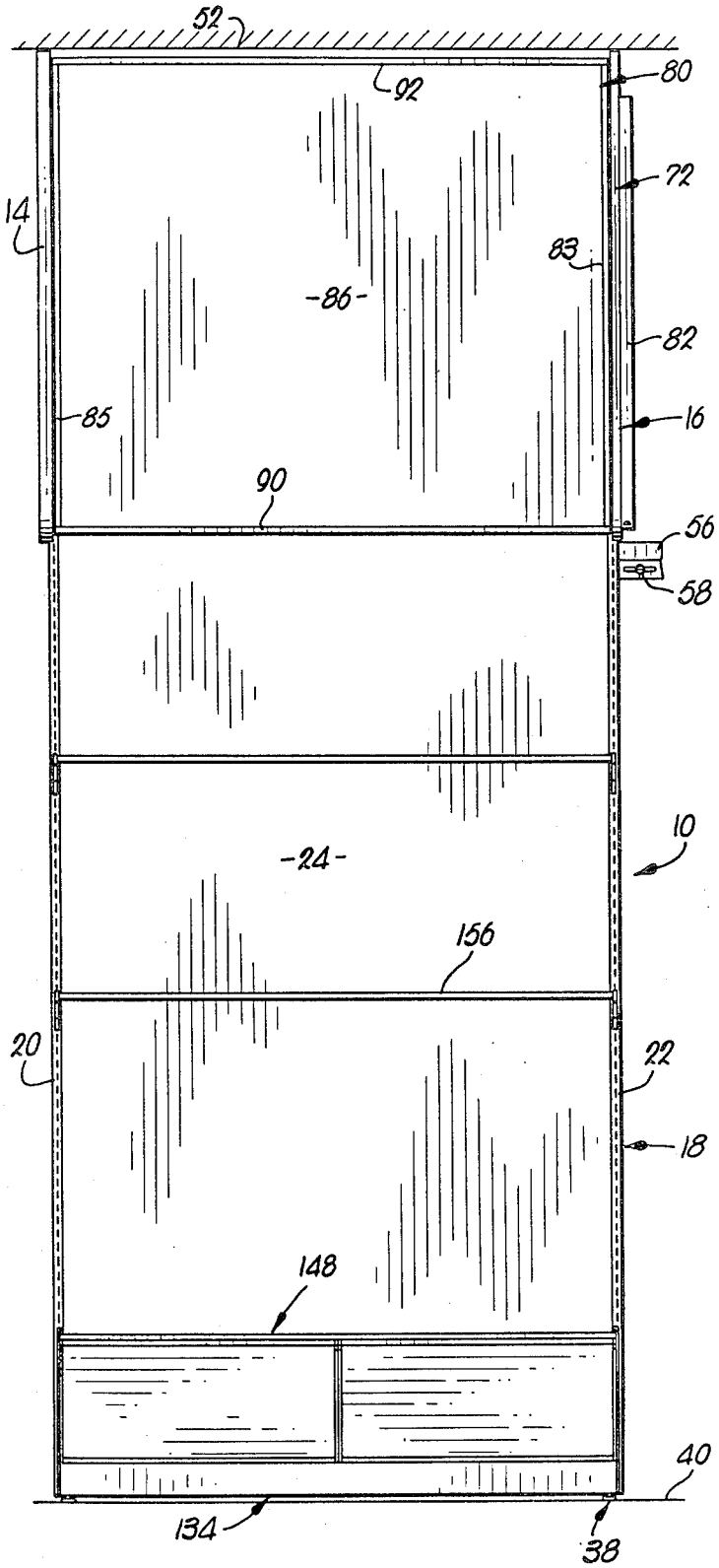
FIG. 2 is a fragmentary front elevational view primarily illustrating one module of an improved wall mounted article display unit constructed in accordance with the preferred concepts of the present invention and showing an end module as well as a small portion of a module adjacent thereto.
Figure 4:
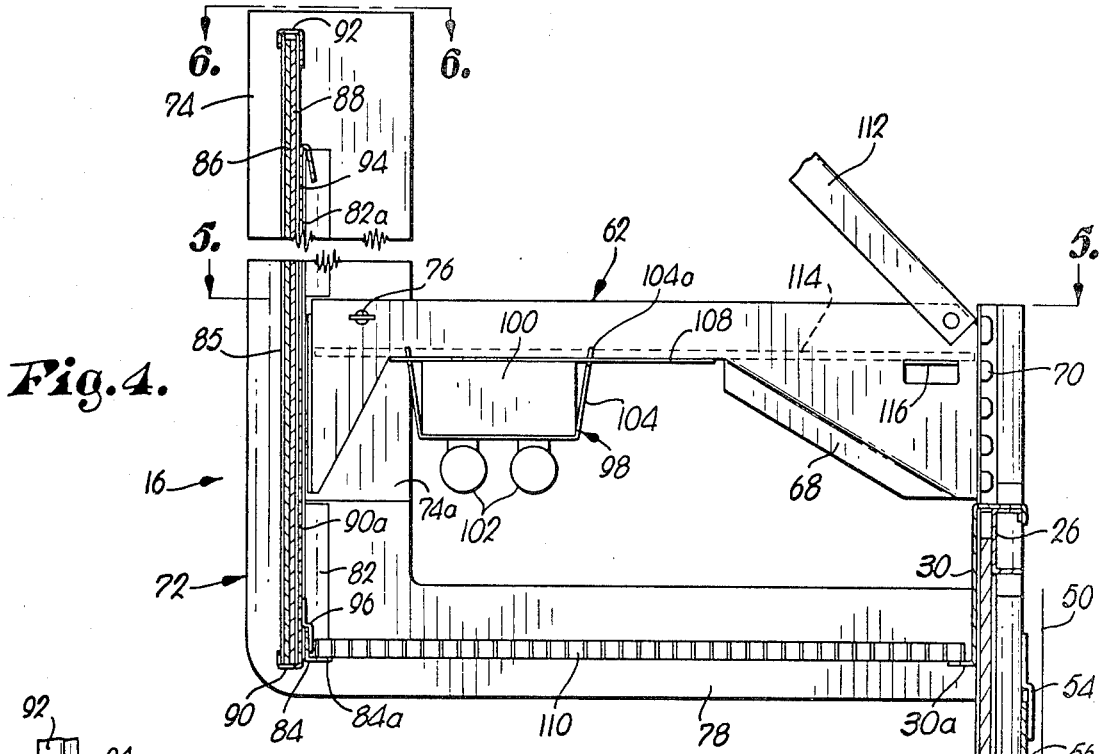
Figure 6:
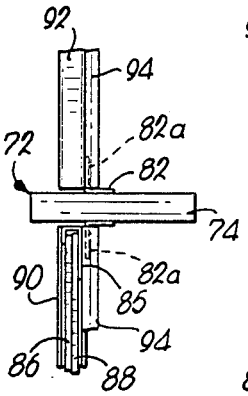
Figure 20:
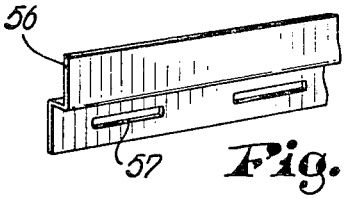
Figure 5:
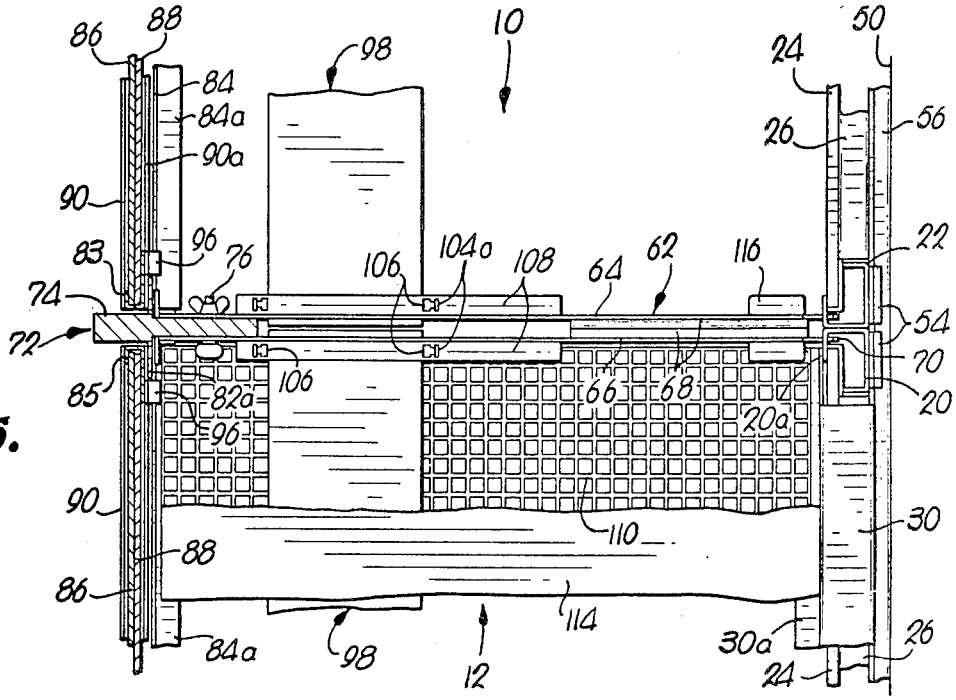
Figure 7:
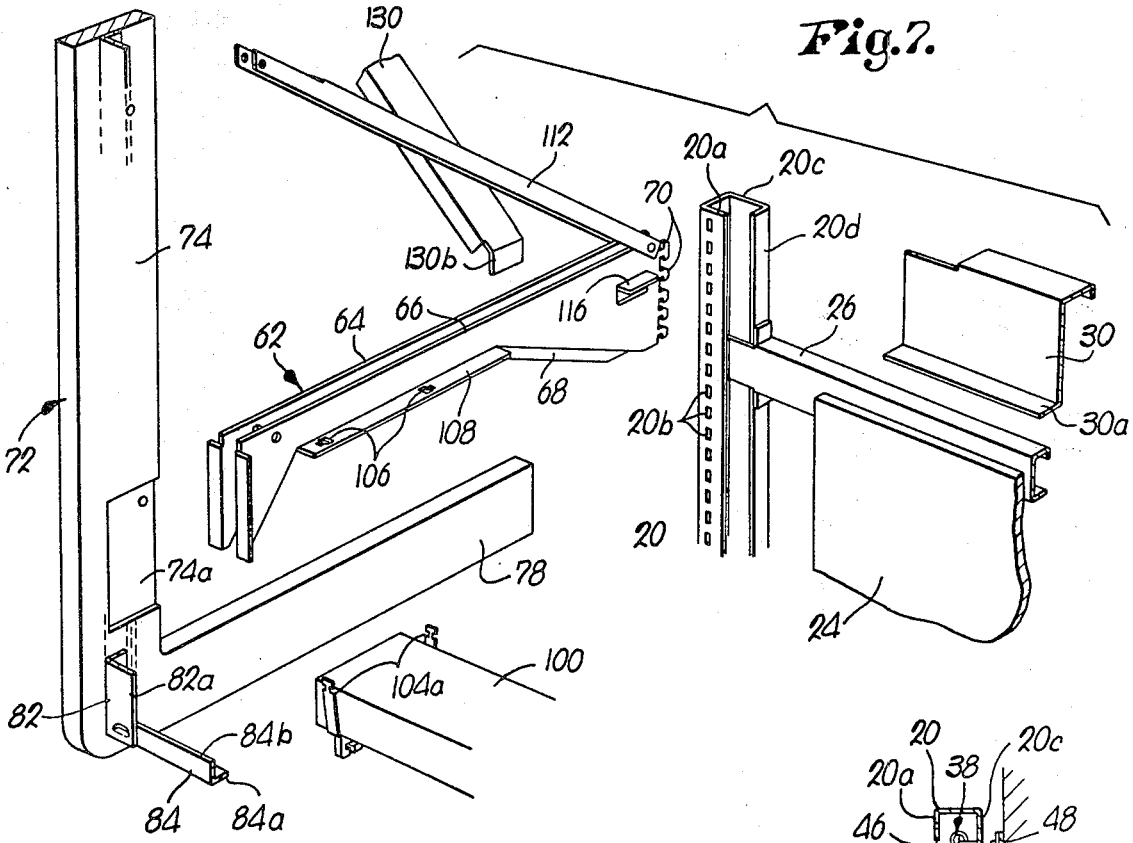
Figure 9:
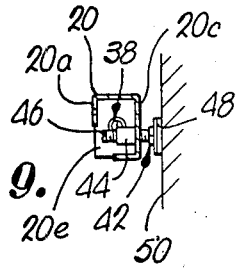
Figure 10:
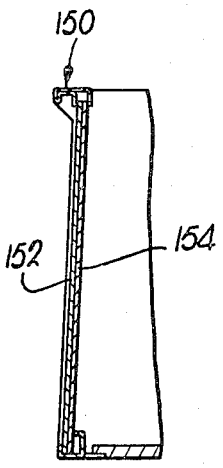
Figure 8:
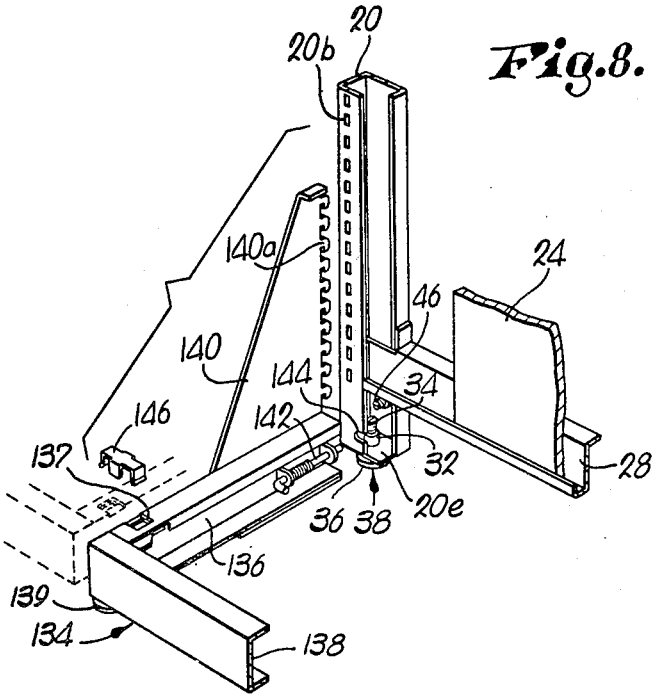

FIG. 4 is an enlarged fragmentary vertical cross sectional view through the upper part of the modular article display unit of FIG. 2 and principally showing the soffit and valance assembly at the upper extremity of the display apparatus which mounts illuminating means for directing light onto articles displayed therebelow and also embodying decorative panel means across the front face of the assembly which may be reversed or replaced as desired for seasonal promotion purposes;

FIG. 5 is a fragmentary horizontal cross sectional view taken substantially on the line 5—5 of FIG. 4 and looking downwardly in the direction of the arrows;

FIG. 6 is a fragmentary top plan of the valance fin and associated valance panels, taken substantially on the line 6—6 of FIG. 4 and looking downwardly on the structure therebelow;

FIG. 7 is a fragmentary perspective exploded view of the cantilever support structure for supporting decorative panels on the upper end of each standard of a modular display unit and illustrating a portion of a cross-brace used to supprt an end wall of the display apparatus;

FIG. 8 is also an exploded perspective view of the lower end of the standard shown in the FIG. 7 and illustrating the components of the kickbase at the lower end of the display equipment;

FIG. 9 is a fragmentary horizontal cross-sectional view through the lower end of the standard illustrated in FIG. 8 and better showing the construction of the adjustable stop for limiting movement of the bottom extremity of the standard toward the adjacent supporting wall surface;

FIG. 10 is a fragmentary vertical cross-sectional view through one of the front panels of a drawer provided at the bottom of the modular display units mounted on top of an associated kickbase;

FIG. 11 is a top plan view of the end wall forming a part of an end article display unit and showing the associated frame support, cantilever brackets and braces in fragmentary form;

FIG. 12 is a fragmentary vertical cross-sectional view taken on the line 12—12 of FIG. 11 and looking to the right as indicated by the arrows;

FIG. 13 is a fragmentary front elevational view of the valance and soffit assembly of another embodiment of the invention used for lower or higher than normal ceilings wherein a fascia panel of predetermined width is removably mounted on the front of the cantilever support brackets;

FIG. 14 is a side elevational view of the soffit and fascia assembly illustrated in FIG. 13 and looking into the structure from the right hand side thereof viewing FIG. 13;

FIG. 15 is an enlarged fragmentary view showing the fascia panel illustrated in FIG. 14 with a portion of the support bracket therefor;

FIG. 16 is an enlarged fragmentary rear elevational view of the fascia support bracket depicted in FIG. 13 and particularly illustrating the keyhole slot and headed fastener useable therewith for releasably locking the fascia panels on the supporting brackets;

FIG. 17 is an enlarged cross-sectional view taken substantially on the line 17—17 of FIG. 16;

FIG. 18 is a fragmentary perspective view of the corner of the retail area receiving the display equipment illustrated in FIG. 1 and showing the room prior to mounting of the display units therein with the Z-tie bar illustrated in a normal position thereof relative to the floor and ceiling structures of the room;

FIG. 19 is a fragmentary perspective view similar to FIGS. 1 and 18 and showing the disposition of one modular support frame of a display unit and showing the panel thereof which serves along with the overhead soffit and valance assembly to cover the wall surface therebehind; and FIG. 20 is a fragmentary perspective view of one end of the Z-shaped tie bar used to hold the display units against the wall and better illustrating the fastener receiving slots provided therein along the longitudinal length of the same.

DETAILED DESCRIPTION

Article display apparatus embodying the novel features of this invention is illustrated in two forms in the drawings, one being especially suitable for use in conventional retail or product display areas having standard ceiling heights of about 10 ft., while the other unit is especially useful in areas where the ceiling height is lower, as for example of the order of 8 ft., or substantially higher as is the case with 12 ft. ceilings. Many of the components of the two article display systems are common with the primary difference being the nature of the valance or fascia forming the forward part of the valance and soffit assembly adjustably mounted on the support frame of each modular unit of the display equipment. FIG. 1 illustrates a typical installation in the case where the ceiling is of more or less standard height, i.e., 10 ft. and therefore the valance and soffit assembly extends upwardly to a position in close proximity to the overhead ceiling to give a built-in, customized look to the display installation. Thus, referring initially to the display apparatus shown in FIGS. 1–12 inclusive an end modular display unit is broadly designated by the FIG. 10. It is to be understood in this respect that the end unit 10 differs from intermediate modular units 12 primarily in the provision of an end wall panel 14 closing the exposed end of the overlying soffit and valance assembly 16 cantilever mounted on each of the frame units 18 serving as the primary support for the article display shelves or bins as well as the assembly 16 thereabove.

Referring to FIG. 2, each of the display modules 10 and 12 is made up of a pair of elongated slotted standards 20 and 22 which are of channel shaped configuration as best shown in FIGS. 5 and 7 although the slotted standards may be of any desired cross-sectional configuration, the open channel arrangement shown in greatest detail in FIG. 7 is of particular advantage because of the strength thereof and inherently functions as a groove defining member for receiving the corresponding edge of a decorative backing board as will be explained.

As is apparent from FIGS. 5 and 7, the forwardly facing front section 20*a* of standard 20 having a series of vertically aligned slots 20*b* therein is integrally joined to one edge of a U-shaped rear segment 20*c* which has a forwardly facing edge 20*d* that terminates in sufficiently spaced relationship from the plane of front section 20*a* to accommodate the edge of backing board 24 therebetween. Each of the modular units 10 and 12 therefore has left and right standards 20 and 22 which have upright facing grooves therein for receiving and holding the vertical edges of a corresponding decorative backing board 24.

A horizontal channel shaped connector 26 suitably affixed to the standards 20 and 22 proximal to the top ends thereof as well as a lower J-shaped cross element 28 joined to and interconnecting the lower extremities of the standards provide a rectangular frame which receives and fully supports the backing board 24. As is most evident from FIG. 8, the lower, forwardly facing relatively shallow channel defined by the bottom part of J-channel 28 is of dimensions to complementally receive the bottom edge of back board 24. Means for holding the uppermost extremity of backing board 24 in proper disposition preferably comprises a Z-shaped element 30 having an upper hook shaped portion which fits over the top edge of connector channel 26 as well as the upper edge of backing board 24. Forwardly facing lip 30*a* of element 30 acts as a support for a light diffusing grid forming a part of assembly 16 as shown in FIG. 4 and will be detailed hereinafter.

An integral cross wall 20*e* at the bottom end of each of the standards 20 and 22 serves as means for mounting a threaded collar 32 which communicates with a suitable opening aligned therewith in cross wall 20*e* and which in turn rotatably receives a threaded rod 34 supporting a circular support foot 36 below wall 20*e*. Vertical adjustment of the foot assembly 38 presented by foot and rod 34 allow the standards 20 and 22 to be not only shifted up and down for alignment purposes but also to provide compensation for horizontal irregularity in the finished floor 40 (FIG. 1) of the retail area in which the article display system is installed.

Similarly, the rearmost wall section of channel segment 20*c* of each standard 20 and 22 has an adjustable stop broadly designated 42 which is similar to foot member 38 in that an internally threaded collar 44 is secured to the inner face of channel section 20*c* and rotatably receives a threaded rod 46 integral with circular foot 48 adapted to bear against the vertical face of wall 50 extending between floor 40 and the overhead ceiling 52. Stop 48 serves to permit true vertical positioning of standards 20 and 22 relative to the wall and to preclude movement of the lower end of the frame unit 18 toward the base of wall surface 50.

Frame unit 18 is adapted to be held against wall 50 by two Z-shaped, downwardly opening clips 54 (FIG. 4) mounted on the upper extremities of standards 20 and 22 in disposition to interlock with a Z-shaped tie bar element 56 affixed to wall 50 using suitable fasteners 58. As will be explained, the Z-bar 56 is located on wall 50 and positioned such that the clips 54 interlock therewith but providing space between the upper edge of the Z-bar and the inside transverse surface of the clips 54 to permit limited vertical adjustment of frame units 18 as may be necessary to assure horizontal alignment thereof throughout the length of the retail area 60 defined by the wall, floor and ceiling surfaces illustrated in FIGS. 1, 18 and 19. It is therefore apparent as for example illustrated in FIG. 4 that the frame units 18 rest on and are fully supported by the floor and are simply restrained from moving away from wall 50 by clips 54 engaging respective portions of the horizontal tie bar 56. As detailed in FIG. 20, each of the tie bars 56 is provided with a series of spaced, elongated, longitudinally extending fastener clearing slots 57 therein permitting variation of the through positions of fasteners 58 as necessary for securing of the tie bar to areas of the wall 50 which assure firm fixation thereof the upright surface.

Figure 3:
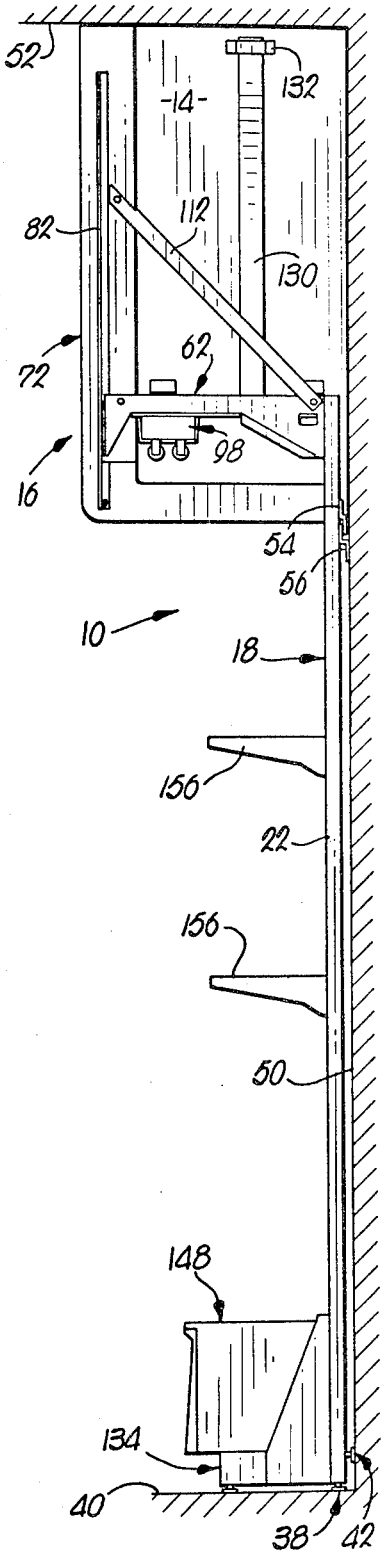
FIG. 3 is basically a side elevational view of the modular article display unit illustrated in FIG. 2 looking at the right hand side of the latter.

In order to impart built-in, customized appearance to the display system notwithstanding prefabrication of the components and standardization of the elements thereof, an overhead soffit and valance assembly 16 is cantilever mounted on the standards 20 and 22 of each of the units 10 and 12 with the valance portion thereof extending to a point adjacent ceiling 52 in those instances where conventional ceiling heights are employed, which for example are usually 10 ft. above floor 40. Since the end unit 10 embodies all of the different components of each module it will be described in detail with the differences between the end module and the intermediate units being separately delineated. As illustrated in FIG. 5, the standard 22 of end unit 10 is in side-by-side, parallel, proximal, generally abutting relationship to the standard 20 of the next adjacent intermediate display unit 12. A support bracket 62 is cantilever mounted on adjacent standards 20 and 22 and serves to interconnect the upper extremities thereof. As is evident from FIGS. 4 and 7, the bracket 62 has a pair of irregularly configured, forwardly projecting panel members 64 and 66 which are identical except comprising mirror images of each other and are maintained in horizontal spaced relationship by integral, L-shaped connector segments 68 proximal to the end of the bracket 62 which connects to standards 20 and 22. A series of hook-shaped extensions 70 projecting rearwardly from the back portions of panel members 64 and 66 are adapted to be received in corresponding slots **20*b* of standards 20 and 22 for cantilever support of bracket 62 on the slotted standards as is depicted in FIGS. 3 and 4.**

A generally L-shaped decorative divider component 72 is mounted on the outer end of bracket 62 with the end extremities of panel members 64 and 66 embracing the upright leg 74 of component 72 within complemental cutouts **74*a* therein. Fastening means 76 extending through panel members 64 and 66 as well as the leg 74 of component 72 therebetween, firmly affixes the fin component to bracket 62.**

The horizontal leg of component 72 is of a length to return to the upright faces of adjacent standards 20 and 22 at a level desired for the soffit of assembly 16 and preferably is of sufficient rigidity to avoid the necessity of the inner extremity thereof being directly connected to the support frames.

The upright leg 74 of each pair of divider components 72 of respective modules 10 and 12 has mounting means thereon for supporting decorative fascia or valance structure broadly designated 80. Referring specifically to FIGS. 3, 4, 5 and 7, upright angles 82 are mounted on each of the opposed vertical faces of leg 74 of each component 72 and extend from the lower part of the support component to a point ajacent the upper extremity thereof. Cross-angle 84 releasably coupled to respective outturned segments **82*a* by suitable inturned tab and slot connections serve not only to stabilize the components 72 but also present an inturned lip 84*a* which is horizontally aligned with lip 30*a* of Z-shaped element 30** in direct opposition thereto.

Panel structure 80 includes a pair of outwardly facing, transversely J-shaped side supports 83 and 85 (FIG. 5) presenting grooves therein of dimensions to receive the edges of a pair of rectangular panels 86 and 88 which preferably have different decorative color on respective faces thereof. For example, the outer face of panel 86 may be colored red, the inner face thereof green, the face of panel 88 adjacent panel 86 of white color, while the inwardly facing surface of panel 88 is orange or gold. The lower edges of panels 86 and 88 rest in a groove defined by transversely J-shaped bottom support 90 extending between and connected to upright supports 83 and 85. A removably channel-shaped cap 92 closes the top of the frame assembly and rests on the upper ends of supports 83 and 85 in covering relationship to the upper extremities of panels 86 and 88.

A hook element 94 of inverted J-shaped transverse configuration extending between supports 83 and 85 below the upper edges thereof is strategically located to hook over the upper ends of outturned segments **82*a* of corresponding angles 82. In addition, a pair of Z-shaped clips 96 are affixed to the rear face of bottom support 90 in disposition to hook over the upturned section 84*b* of cross-angle 84. It is to be noted in this respect that the upwardly extending rearmost panel portion 90*a* of bottom support 90 extends upwardly to a level approximating that of brackets 62 in order to prevent light from the illuminating means to be hereinafter detailed from casting a colored reflection downwardly onto back board 24** and articles displayed in front thereof.

In the preferred embodiment of the modules 10 and 12, illuminating means broadly designated 98 is suspended from adjacent pairs of brackets 62 above inturned leg portions 78 of divider components 72. In the preferred embodiment of the invention as illustrated, illuminating means 98 comprises a flourescent tube assembly including a horizontal box housing 100 supporting conventional ballast and starter mechanism electrically connected to a pair of fluorescent tubes 102 therebelow which extend substantially the full distance between adjacent pairs of brackets 62. Means for suspending the housing 100 from brackets 62 may take the form of a U-shaped strap 104 at each end of the housing 100 provided with generally I-shaped ends **104*a* which are adapted to be received in horizontally spaced T-slots 106 provided therefor in integral flanges 108 projecting outwardly from respective lower edges of panel members 64 and 66 of each bracket 62. The U-straps 104** are constructed so that the upright I-shaped legs thereof tend to deflect outwardly to assure retention thereof in corresponding T-slots 106. Preferably, the illuminating means 98 is located toward the front of the soffit and valance assembly 16 in closer relationship to panel structure 80 than standards 20 and 22 and the associated back board 24 mounted thereon. This assures uniform lighting of articles displayed on shelf structures carried by standards 20 and 22 in vertically stacked relationship.

As previously indicated, a horizontal, light-diffusing grid 110 is removably positioned below illuminating means 98 and defines a soffit which rests on and is supported by lip 30*a* of element 30 and the lip 84*a* of cross-angle 84.

A cross-brack 112 is provided between the innermost end of each bracket 62 and an upper extremity portion of the upright leg 74 of an associated component 72. Horizontal light deflector and dust cover 114 of generally rectangular configuration rests on outturned flanges 108 of panel members 64 and 66 as well as an outturned lip 116 thereon above illuminating means 98.

End module 10 differs from intermediate modules 12 in that an end closure panel 14 is mounted on the frame unit 18 in lieu of divider components 72. As is best shown in FIGS. 11 and 12, means for supporting the end panel 14 preferably comprises a bracket 118 which comprises one of the panels 64 or 66 depending upon whether it is a left or right hand end module. In FIG. 11 for example, a left hand end wall panel 14 is illustrated, and therefore the bracket 118 is identical to panel member 66 shown in FIG. 7. As such, the bracket 118 has hook-shaped extensions 120 thereon complementally received within slots at the upper end of the associated standard 20 and means is provided for securing the outermost end of the bracket panel member to wall panel 14. To this end, Z-shaped clips 122 and 124 affixed to the inner surface of wall panel 14 are adapted to hook over the panel section 126 of bracket 118. This arrangement allows the wall panel 14 to be removed from the bracket support therefor by simply moving such panel upwardly until the lower ends of the clips clear the upper edge of the bracket. By the same token, outturned flange 128 of bracket 118 is of identical construction to the flange 108 on panel member 64 and 66 of bracket 62 to provide end support for an associated fluorescent lighting unit 98. Further means for stabilizing the end wall panel 14 may take the form of a cross-brace 130 of U-shaped configuration having an upturned lip 130*a* on the upper end thereof adapted to be received within a U-strap 132 secured to the inner face of wall panel 14 adjacent the upper edge thereof. The lowermost extremity of the brace 130 has a downturned lip 130*b* which is received between proximal panel members 64 and 66 of the next adjacent bracket 62 so that the downwardly extending edge sections of channel 130 engage the upper margin of the proximal panel member 64 to preclude relative movement between wall panel 14 and the proximal bracket 62.

Kickbase 134 at the bottom of the frame unit 18 has a pair of forwardly extending channels 136 connected to an outer inwardly facing channel 138 extending the full width of the respective module 10 or 12. Triangular supports 140 affixed to the outer faces of channel members 136 are provided with rearwardly extending hook-shaped extensions 140*a* thereon located to interlock with respective standards 20 and 22 within the slots therein. Manually operable slide pin structure 142 is provided within each of the channels 136 adjacent the rearmost ends thereof for interengagement with respective standards within slots 44 therein to hold hook extensions 140*a* in the slots therefor in corresponding standards. U-clips 146 are designed to interlock adjacent channels 136 of abutting kickbases 134 within appropriate slots 137 therefor in the upper horizontal sections of channels 136 as best shown in FIG. 8 to preclude relative movement between the kickbases. Adjustable levelers 139 are provided on kickbases 134 which operate identically to levelers 38.

Storage compartments 148 are preferably mounted on each kickbase 134 and may either comprise drawer structures or cabinets with down swinging or out swinging doors as desired by a particular shopkeeper. For example, in FIG. 10, drawer structure is illustrated having an outer rectangular frame 150 presenting an inwardly facing rectangular channel for receiving a pair of decorative panels 152 and 154. Desirably, these panels have faces colored the same as panels 86 and 88 so that the facings of the drawers or doors may be correlated with the colors of the valance panels forming a part of structure 80. As is most apparent from FIG. 10 the panels 152 and 154 may be removed from the frame 150 by shifting the same upwardly until the lower edges thereof clear the front lip of the lower part of the frame thereby permitting both panels to be removed from the drawer for reversal or interchange of the same.

For purposes of illustration only, a plurality of shelf supports and shelves 156 are shown in FIGs. 2 and 3 for supporting articles to be displayed. Other types of shelves are illustrated in FIG. 1 to indicate the variety of article display structures which may be incorporated into the present display system without alteration in the basic construction and assembly thereof.

In setting up a new retail outlet, the property owner or leaseholder normally is supplied only with specified empty space and is obligated to finish the interior thereof as he desires at his own expense. This not only involves installation of an overhead ceiling and floor covering but also finishing of all exposed wall surfaces. Most ceilings are of the drop type because of the necessity of providing sprinkler systems in the area and thus the floor to ceiling height is generally of the order of 10 ft. in most instances where standard conditions are adhered to. The costs involved in finishing of the customer area are significant, particularly as labor costs have risen to a point that custom installation of display cabinets and shelves has become virtually prohibitive in nature. The display system of this invention permits prefabrication of the article display modules at a central location and shipment of the parts thereof to the retail location for installation at the site by relatively unskilled personnel using commonly available tools. As indicated in FIG. 18, the first step in installing modules 10 and 12 is to secure Z-bar 56 to wall 50 at an appropriate level determined by the location of clips 54 on frame units 18. The height of Z-bar 56 should be such that the clips 54 engage the upturned section of the tie element 56 but do not rest thereon so that all of the weight of the display unit and products carried thereby rests on floor 40 at the zone of merger thereof with upright wall 50. Next, frame units 18 are positioned in place against the wall 50 with clips 54 interlocking with tie bar 56 as best shown in FIG. 19. The back boards 24 may either be pre-installed in frames 18 while the frames are laying flat on the floor, or the boards can be warped sufficiently to fit into the grooves therefor in the frame assembly (noting in this respect that the back boards are preferably constructed of relatively inexpensive prefinished materials such as Upsom board). Element 30 is positioned on cross connector 26 after mounting of backing board 24 in the frame assembly. After installation of frames 18, the same are leveled with levelers 38 to bring the same into alignment longitudinally of the wall. In the case where the display units occupy a corner of the retail area as shown in FIGS. 1, 18 and 19, an inside corner unit is placed in the room corner and the intermediate display units 12 next thereto are then positioned in abutting relationship to respective angularly disposed faces thereof. The stops 42 are also adjusted at this time using a level to make certain that the standards 20 and 22 are in truly vertical disposition.

The installer has the option of mounting valance and soffit assemblies 16 on respective frame units 18 or to proceed with installation of kickbases 134 as he sees fit. Assuming that the upper soffit and valance assemblies are to be installed next, the brackets 62 and 118 are positioned on respective standards 20 and 22 at vertical dispositions causing the upper ends of components 72 to be located proximal to ceiling 52 when the overhead installation has been completed. Therefore, after insertion of hook-shaped extensions 70 into appropriate slots in standards 20 and 22 and forcing of the brackets 62 and 118 respectively downwardly to lock the same to frame units 18, the divider components 72 are interfitted between adjacent ends of panel members 64 and 66 and secured thereto by appropriate fasteners 76. Braces 112 are next coupled to corresponding upright legs 74 by the fasteners therefor.

Illuminating means 98 are next hung from brackets 66 using U-shaped straps 104 for this purpose and the electrical cord from the fluorescent unit is plugged into a suitable outlet therefor. Cross-angles 84 are latched to respective upright support angles 82 to tie adjacent divider components 72 together and stabilize the same longitudinally of the display system. The dust panel 114 is placed in position above illuminating means 98 and then the diffuser grid 100 is positioned on the supports therefor as illustrated in FIG. 4.

The decorative valance structure 80 may then be positioned in covering relationship to the front of assemblies 16 by simply lifting the same upwardly until the downturned segments of hook elements 94 and clips 96 fit over the upper ends of support angles 82 and cross-angles 84 as shown in FIG. 4. This completes the overhead soffit and valance assembly and presents a structure resembling a built-in, custom designed display unit which provides direct illumination of articles display on the shelves or bins located therebelow. Divider components 72 serve the function of supporting valance structure 80 as well as to interrupt the longitudinal extent of the same so that if there is slight misalignment of the decorative panels end to end, such misalignment is not noticeable when viewing the display equipment as a whole.

After installation of the kickbases 134 by positioning of the extensions 140*a* of supports 140 in appropriate slots therefor in standards 20 and 22 followed by locking of the kickbase to the frame unit 18 by pin structures 142, the storage compartments 148 may be locked in position on the kickbase as shown in FIG. 3. The final step involves installation of support shelves at any desired height on the vertical extent of frame units 18 between compartments 148 and the overhead soffit and valance assembly. Any number of shelves or bins may be provided on the modules 10 and 12 with the relative height thereof being variable at will by virtue of the fact that the slotted standards permit hanging of the shelves thereon at any selected level.

End panels 14 are positionable on modules 10 by the simple expedient of hooking the clips 122 and 124 over associated brackets 118 followed by installation of cross-brace 130 whereupon the outer cover valance structure 80 may be mounted in covering relationship thereto.

The retailer is able to vary the entire visual appearance of his display area at will by the simple procedure of changing the panel fronts of assembly 16 of each unit 10 or 12 and to correlate the panel covers of the drawers in compartments 148 by reversing or interchanging the panel which faces outwardly for visual observation thereof. In the case of panel structure 80, this is accomplished by simply shifting the latter upwardly to permit removal of frame structure 80 from the supports therefor followed by reversal or change of the panel colors which face outwardly toward the observer. Similar change or reversal of the panels may be made in the drawer or door fronts of storage compartments 148. As can be appreciated, this change may be effected quickly and easily without tools and at the complete option of the merchant. When colors such as red, green, white and gold or orange are made available, then the retailer is in a position to correlate the color of his display with seasonal promotions and to change the entire appearance of his store with minimum effort and no further expense. In addition, the provision of removable panels for the upper valance and soffit assemblies as well as the storage compartments 148 permits supply of relatively inexpensive panels to the retailer with design decorations thereon if desired to correspond with a particular product promotion and which are relatively expandable if constructed of inexpensive materials such as Upsom board or the like.

An alternate valance and soffit assembly is depicted in FIGS. 13–17 inclusive and generally designated by the numeral 216. This overhead assembly is made available for use in those cases where the retailer has a ceiling height which is below or substantially above standard 10 ft. ceiling height. The valance structure 280 is considerably narrower than valance structure 80 and is not designed to extend to a point in proximity to the ceiling.

In the case of assembly 216, all of the components thereof are identical to those previously described with the exception of the use of a planer panel 286 designed to be releasably affixed to special fastener plates 290 provided therefor on the outer ends of respective brackets 62. As is evident in FIGs. 13, 16 and 17, each of the upright plates of brackets 62 associated with intermediate modular units 12 joined to a pair of panel members 64 and 66 has four keyhole slots 292 therein with the upper pair of slots in each plate 290 and the lower pair thereof being oriented so that the narrowest segments thereof extend toward each other as best shown in FIG. 16. As is also shown in FIG. 13, the plates 209*a* associated with end standards 22 of modules 10 are only half as wide as plates 290 and therefore have only two keyhole slots in the same with the narrow portions thereof pointing away from the keyhole slots of an adjacent plate 290. Panels 286 have double headed support pins 294 therein located to be received within respective keyhole slots 292 and then shifted downwardly to lock the panels to brackets 62. In this instance, the divider components 72 are not used so that panels 286 are thereby in tight fitting, end to end abutting relationship. The angular inclinations of keyhole slots 292 in directions away from each other cause the panels 286 to be drawn toward each other so that the proximal ends thereof are brought into close fitting relationship. Further locking of panels 286 to associated brackets 62 and 118 is accomplished by virtue of the fact that the areas of plates 290 having keyhole slots 292 therein are bulged as shown in FIGS. 16 and 17 to present dimpled areas 292*a* which face away from respective panels 286 to cause the same to be drawn toward plates 290 and 290*a* by virtue of the fact that the angle of inclination of each bulged dimple is in a direction to cause the greatest depth thereof to be proximal to the narrowest portion of each of the keyhole slots 292.

Each of the plates 290 and 290*a* has an outturned lip 296 on the lower edge thereof which is adapted to engage a shoulder 298 formed by a cutout area 300 in the lower part of each panel 286 adjacent plates 290 and 290*a* for limiting downward movement of the panels relative to the support structure therefor.

Installation of panels 286 on the supports therefor is believed to be self-evident from the preceeding description. Support for light diffusing grid 110 takes the form of the element 30 of frame units 18 as well as a horizontal angle 302 secured to the back face of each panel 286 adjacent the lower extremity thereof as illustrated in FIG. 14. The diffuser 110 may be removed at will for changing fluorescent tubes of illuminating means 98 by simply pushing the forward or rear edges of the same upwardly until the grid clears the support for removal.

Having thus described the invention, what is claimed as new and desired to be secured by Letters Patent is:

1. In article display apparatus for an area having an upright wall surface extending upwardly from the floor thereof to an overhead ceiling, the improved combination comprising:

a pair of upright standards adapted to be located adjacent the wall surface in disposition to be supported by the floor;

at least one tie element adapted to be mounted on the wall surface intermediate the ends of the standards;

means for coupling the standards to the tie element for preventing swinging movement of the standards away from the wall surface;

means mounted on the standards for receiving articles to be displayed;

a soffit and valance assembly carried by the standards above the article receiving means and including support structure extending forwardly from each standard, upright valance means mounted on the support structure and extending upwardly therefrom toward said ceiling, and soffit defining means carried by the support structures in disposition extending rearwardly from the valance means to a location proximal to the standards; and illuminating means carried by the support structures above the soffit defining means and behind the valance means, said soffit defining means being light pervious to permit light from the illuminating means to be directed downwardly therefrom onto articles carried by said article receiving means.

2. Apparatus as set forth in claim 1 wherein is provided at least two sets of said pair of standards with one standard of each set being in adjacent, side-by-side, parallel relationship to a standard of a proximal set, there being one type of support structure for each pair of side-by-side standards and operable to engage both of the same in interlocking relationship therewith, and another type of support structure releasably mounted on and supported by the endmost standards of the side-by-side sets thereof.

3. Apparatus as set forth in claim 2 wherein each of the soffit and valance assemblies is provided with illuminating means above respective soffit defining means and behind the valance means thereof, each of said support structures being provided with panel members projecting forwardly from respective standards, said one type of support structures having a pair of said panel members located in horizontally spaced relationship and connecting means rigidly intercoupling adjacent pairs thereof, the panel members associated with each of said pairs of standards and the illuminating means of a corresponding soffit and valance assembly having interengageable mechanism for supporting the illuminating means in the normal operative position thereof.

4. Apparatus as set forth in claim 3 wherein is provided an end component secured to each of the panel members projecting outwardly from said endmost standards, and intermediate components joined to and located between the panel members extending forwardly from adjacent pairs of standards, the components of each soffit and valance assembly having means thereon projecting upwardly from respective panel members for removably supporting the valance means thereon.

5. Apparatus as set forth in claim 4 wherein each of said end components is of generally rectangular configuration and located to close the exposed end of the soffit and valance assembly.

6. Apparatus as set forth in claim 4 wherein each of said intermediate components is of generally L-shaped configuration having a horizontal leg extending forwardly from each pair of adjacent, side-by-side standards and an outer upright leg connected to the panel members of an associated pair thereof and extending upwardly from the same a sufficient distance to terminate in proximal relationship to said ceiling, said means for supporting respective valance means being mounted on said upright legs and supported thereby.

7. Apparatus as set forth in claim 6 wherein said upright legs of the intermediate components extend between the panel members associated therewith, the means for joining the upright leg of each component to respective panel members comprising fasteners extending therethrough for releasable coupling of each intermediate component to said panel members therearound.

8. Apparatus as set forth in claim 3 wherein said soffit defining means comprises light diffusing means located below each of the illuminating means and aligned with the horizontal legs of said L-shaped components.

9. Apparatus as set forth in claim 8 wherein each of said light diffusing means comprises a cellular grid element in horizontal disposition, and means for removably supporting each of the grid elements in the operative location thereof.

* * * * *